US005140560A

United States Patent [19]

Percy

[11] Patent Number: 5,140,560

[45] Date of Patent: Aug. 18, 1992

[54] PRESSURE COMPENSATED TRANSDUCER SYSTEM WITH CONSTRAINED DIAPHRAGM

[75] Inventor: Joseph L. Percy, San Diego, Calif.

[73] Assignee: The United States of America as represented by the Secretary of the Navy, Washington, D.C.

[21] Appl. No.: 227,937

[22] Filed: Jul. 29, 1988

[51] Int. Cl.[5] ..... H04R 1/02

[52] U.S. Cl. ..... 367/174; 367/163; 367/167; 367/172

[58] Field of Search ..... 367/163, 165, 167, 172, 367/174, 141; 181/120; 310/337

[56] References Cited

U.S. PATENT DOCUMENTS

| | | | |
|---|---|---|---|
| 2,434,469 | 1/1948 | Myers | 367/174 |
| 2,758,203 | 8/1956 | Harris | 250/17 |
| 3,000,216 | 9/1961 | Peters et al. | 73/398 |
| 3,126,559 | 3/1964 | Alexander | 9/10 |
| 3,262,093 | 7/1966 | Junger et al. | 340/10 |
| 3,345,607 | 10/1967 | Nelkin et al. | 340/8 |
| 3,436,776 | 4/1969 | Davis | 9/8 |
| 3,567,562 | 3/1971 | Gordon et al. | 161/7 |
| 3,789,166 | 1/1974 | Sebesta | 381/205 |
| 3,854,116 | 12/1974 | Toulis et al. | 340/8 L |
| 3,993,973 | 11/1976 | Hutchins et al. | 367/172 |
| 4,030,063 | 6/1977 | Wallen | 181/120 |
| 4,034,693 | 7/1977 | Challenger | 114/16 E |
| 4,183,422 | 1/1980 | Williams | 181/173 |
| 4,384,351 | 5/1983 | Pagliarini et al. | 367/175 |
| 4,420,826 | 12/1983 | Marshal et al. | 367/167 |
| 4,507,093 | 3/1985 | Norvell | 441/2 |
| 4,524,693 | 6/1985 | McMahon et al. | 367/167 |
| 4,541,079 | 9/1985 | Thigpen | 367/19 |

*Primary Examiner*—J. Woodrow Eldred

*Attorney, Agent, or Firm*—Harvey Fendelman; Thomas Glenn Keough; Peter A. Lipovsky

[57] ABSTRACT

An acoustic source apparatus has a acoustic transducer that is enclosed in a substantially rigid and watertight enclosure to resist the pressure of water on the transducer and to seal the transducer from the water. The enclosure has an opening through which acoustic signals pass and over which is placed a resilient, expandable and substantially water-impermeable diaphragm. A net stiffens and strengthens the diaphragm as-well-as constrains the diaphragm from overexpansion or from migrating due to buoyancy forces. Pressurized gas, regulated at slightly above ambient pressure, is supplied to the enclosure and the diaphragm to compensate for underwater ambient pressures. Gas pressure regulated at above ambient pressure is used to selectively tune the pressure levels within the enclosure and diaphragm so that diaphragm resonance can be achieved. Controls are used to selectively fill, as-well-as vent the enclosure and diaphragm during system descent and ascent, respectively. A signal link is used to activate these controls and to provide the driving force for the acoustic transducer.

9 Claims, 2 Drawing Sheets

PRESSURE COMPENSATED TRANSDUCER SYSTEM WITH CONSTRAINED DIAPHRAGM

STATEMENT OF GOVERNMENT INTEREST

The invention described herein may be manufactured and used by or for the Government of the United States of America for governmental purposes without the payment of any royalties thereon or therefor.

CROSS-REFERENCE TO RELATED APPLICATION

This application is related to the co-pending application titled "Constrained Diaphragm Transducer" filed Jul. 28, 1988 by Joseph L. Percy.

BACKGROUND OF THE INVENTION

1. Field of the Invention

The invention relates generally to the field of electrical communications. More specifically, the invention relates to acoustic wave systems and devices. In greater specificity, but without limitation thereto, the invention relates to a pressure compensated, underwater signal transducer apparatus having an electrically driven, constrained diaphragm.

2. Description of Related Art

Underwater communication is commonly made through acousto-electric signal transducers. Typically, these transducers are acoustic loudspeakers housed within watertight and pressure-resistant enclosures. Operation of these loudspeakers produces air perturbations within the transducer enclosure, which are in turn passed to a resilient membrane or diaphragm that covers an open part of the enclosure. The diaphragm serves to transmit these air perturbations to the underwater medium.

Deploying apparatuses of this kind to substantial ocean depths has resulted in ocean pressure inwardly distorting the transmitting diaphragm, ultimately disrupting or destroying the enclosed loudspeaker. To resist the destructive effects of ocean depths, many underwater signal transducers are internally pressure compensated. Further, in devices of this design, the interior pressure of the transducer is often increased to tune the transducer for resonance. These pressure increases can cause the transmitting membrane to migrate and/or rupture.

Thus it can be seen that there is a continuing need for an improved pressure compensated transducer device.

SUMMARY OF THE INVENTION

The present invention is a pressure compensated underwater signal transducer apparatus having an electrically driven, constrained diaphragm. A loudspeaker, housed within an enclosure, has a front side enclosed by a resilient and expandable diaphragm. The diaphragm picks up pressure perturbations from the loudspeaker and transmits these perturbations to the ocean medium in the form of acoustic signals. A constraining net, attached to the transducer enclosure, surrounds the diaphragm. The net constrains the diaphragm from becoming overextended due to elevated internal transducer pressures. Additionally, the net keeps the diaphragm from migrating due to buoyancy, and serves to stiffen and strengthen the diaphragm so that higher source levels at resonant frequencies are possible.

High pressure gas is used to substantially equalize internal transducer pressures with that of ambient undersea pressures. This gas also is used for tuning the transducer assembly for resonance. The high pressure gas is first brought to a manageable level by a first or moderating pressure regulator. An output of this regulator is connected to a second pressure regulator set to deliver the gas at slightly above ambient pressure. Gas from this second pressure regulator goes through a control valve to fill the transducer enclosure and diaphragm with a gas pressure slightly above the ambient undersea pressure. A second output of the moderating or first regulator goes through another control valve, and is used to finely tune the internal pressure of the transducer enclosure and diaphragm so that diaphragm resonance frequencies can be attained. Finally, a third control valve is used to vent the transducer enclosure and diaphragm while undersea ascent is made. This venting stabilizes internal system pressures to prevent undersea pressures from disrupting or destroying the transducer during system recovery.

OBJECTS OF THE INVENTION

It is a primary object of the invention to provide a pressure compensated underwater signal transducer apparatus having a diaphragm capable of high acoustic source loads.

It is a further object of the invention to provide a pressure compensated underwater signal transducer apparatus with a diaphragm capable of withstanding high external and internal pressures.

It is yet a further object of the invention to provide a pressure compensated underwater signal transducer apparatus having a diaphragm that is strengthened and stiffened to thereby increase the resonance frequency, impedance and quality factor of the transducer while decreasing the bandwidth of the transducer system.

Still yet a further object of the invention is to provide a pressure compensated underwater signal transducer apparatus having a diaphragm that is constrained from overextension due to internal pressure adjustment, and that is prevented from migrating due to buoyancy effects.

Other objects and many of the attendant advantages of this invention will become readily appreciated as the same becomes better understood by reference to the following detailed description when considered in conjunction with the accompanying drawings.

DESCRIPTION OF THE PREFERRED EMBODIMENT

Figure 1:
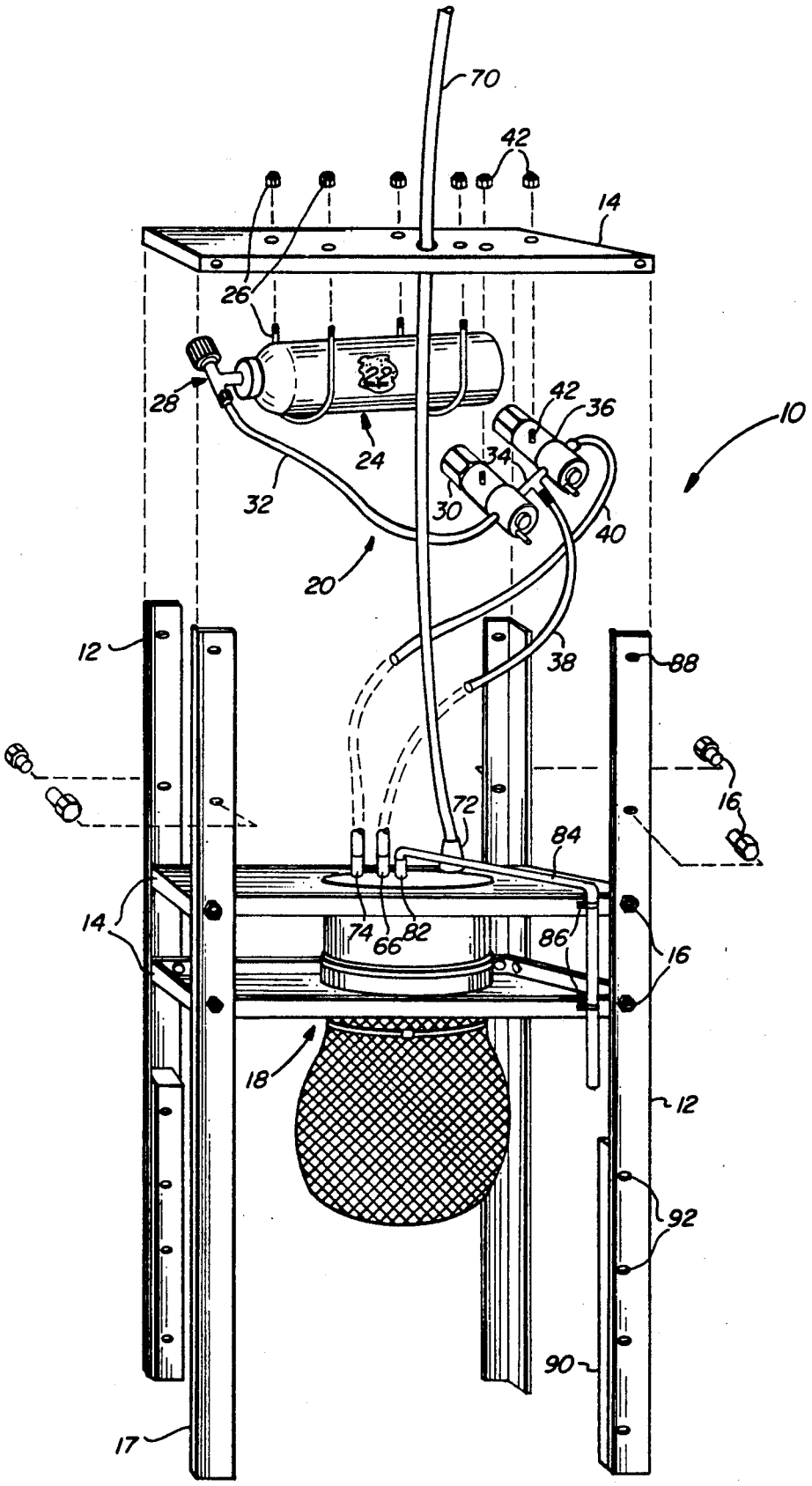
FIG. 1 is a partially exploded, perspective view of a pressure compensated underwater signal transducer apparatus of the present invention.

Referring to FIG. 1 there is shown, in partially exploded view, a pressure compensated signal transducer apparatus 10 of the present invention. Apparatus 10 includes a plurality of frame legs 12 and mounting tables 14 attached to legs 12 by conventional fasteners 16.

The apparatus also includes a transducer assembly shown generally at 18 and pressurized gas elements shown generally at 20. High pressure gas 22 is provided to transducer assembly 18 from a gas bottle 24 in which the gas under pressure has been stored. The gas bottle can be an air tank as is used in scuba operations, and as is customarily charged to about 2200 psi. The bottle is mounted to one of the tables 14 by conventional U-bolts and fasteners 26. The gas is fed from a conventional stopcock 28 to a first pressure regulator 30 by way of a high pressure conduit or hose 32.

First pressure regulator 30 is used to bring high pressure gas 22 down to a preselected manageable level. For example, a level found suitable for this purpose, and as utilized with the invention, was 26 pounds per square inch above ambient. Output of the first pressure regulator is jointly shared through a connecting tee 34 by a second pressure regulator 36 and by transducer assembly 18, the latter being by way of a conduit or hose 38.

Second pressure regulator 36 is set to deliver gas at slightly above ambient pressure to the transducer assembly 18. This gas is transferred to the assembly by way of a conduit or hose 40. The second pressure regulator was set slightly above ambient pressure, as indicated by a small deflection on a positive pressure gauge, to insure proper operation of the regulator.

Regulators 30 and 36 are mounted to one of tables 14 by conventional fasteners 42, and can be self-adjusting, dome-loaded pressure regulators as are available through Tescom Corporation of Elk River, Minn. As can be seen, transducer assembly 18 is held in place by two of the tables 14.

Figure 2:
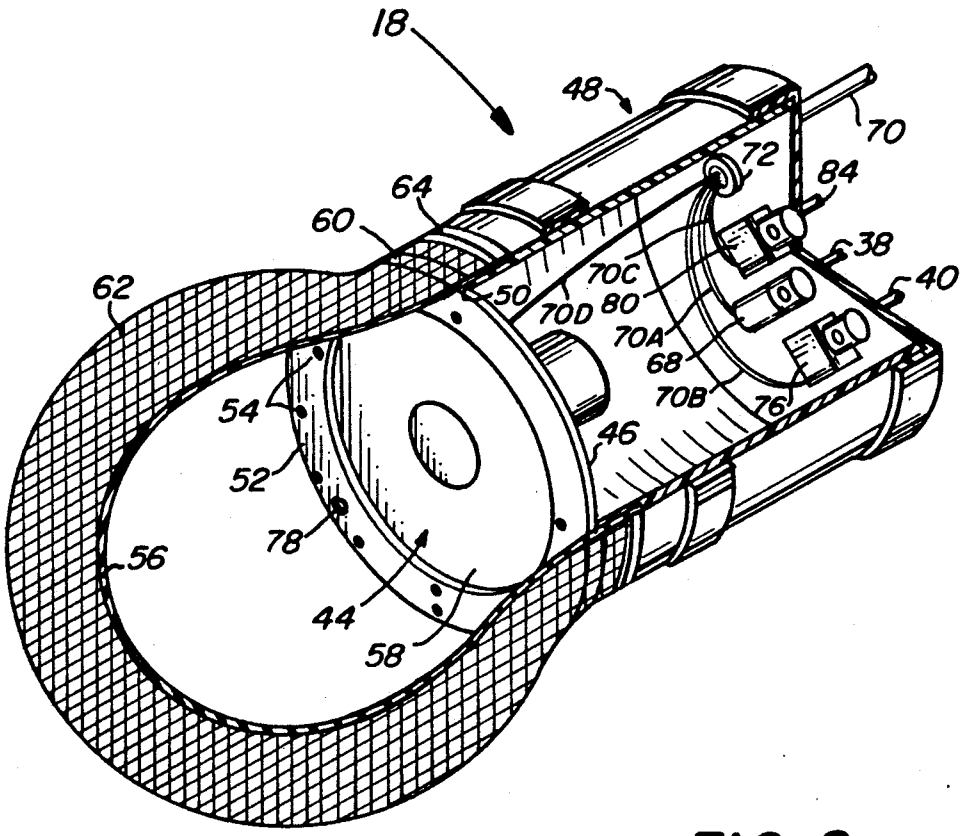
FIG. 2 is an isometric view of a portion of a signal transducer assembly shown in FIG. 1.

Referring now to FIG. 2, there is shown a detailed view of transducer assembly 18 that includes an acoustic transducer 44 such as a conventional electromagnetic loudspeaker. Other acousto-electrical transducers of the piezoelectric or magnetostrictive type may be utilized with the invention as per sound engineering principles. The loudspeaker has a back side 46 surrounded by a substantially watertight and pressure resistant enclosure 48 and is mounted to an open end 50 of the enclosure by way of a flange 52 and conventional fasteners 54.

A resilient, expandable and substantially water impermeable diaphragm or bladder 56 covers a front side 58 of loudspeaker 44 and is placed over open end 50 of enclosure 48. Diaphragm 56 is sealed to open end 50 of enclosure 48 by means such as a conventional hose clamp 60. The diaphragm 56 is typically a balloon, such as is available through commercial sources.

A constraining net 62 is used to limit the peripheral boundaries of diaphragm 56. Constraining net 62 is securely fastened to enclosure 48 by any suitable means such as a conventional cable tie 64.

Referring to both FIGS. 1 and 2, the means by which transducer assembly 18 is pressurized can be seen. Pressurized gas flows from first pressure regulator 30 through tee 34 and hose 38 to a connector 66, sealably fastened to enclosure 48 of transducer assembly 18. A first control valve 68 is disposed within the interior of enclosure 48 in fluid communication with the pressurized gas by way of a connector 66. A signal link 70, connected to a remote signal source not shown, is fastened to enclosure 48 by a watertight and pressure resistant coupling 72. First control 68 is connected to signal link 70 by link 70A.

In a manner like that of first pressure regulator 30, pressurized gas flows from second pressure regulator 36 through hose 40 to a connector 74. Connector 74, like connector 66, provides a substantially airtight and watertight passage through and into enclosure 48. A second control valve 76 is positioned within enclosure 48 and attached to connector 74 to control the flow of gas from second pressure regulator 36. Second control valve 76 is suitably connected for control by signal link 70 via link 70B. Gas provided through the first and second control valves fills enclosure 48 and passes therefrom through a vent 78 to the interior defined by diaphragm 56. Venting of the gas takes place through a third control valve 80 when appropriately controlled by interconnected link 70C of signal link 70. The third control valve is fluidly connected to the ambient by way of a connector 82, that is passed through enclosure 48 in a substantially airtight and watertight fashion, and by a vent line 84 that is extended from transducer assembly 18 and that is fastened to tables 14 by conventional fasteners 86.

During operation of transducer apparatus 10, suspension cables, not shown, are fastened to apparatus 10 at a point such as anchor holes 88 defined by frame legs 12. Apparatus 10 is also sufficiently weighted, such as by the weights 90 mounted to frame legs 12 by conventional fasteners 92, to speed underwater descent and to overcome any positive buoyancy of the apparatus.

During the descent of apparatus 10 below the ocean surface, implosion of loudspeaker 44, due to hydrostatic pressure acting inwardly on diaphragm 56, is prevented by a constant feed of gas at slightly above ambient pressure from second pressure regulator 36 through second control valve 76. During this descent phase, control valve 76 is opened while control valves 68 and 80 are closed. Control valves 76 and 80 are suitable signal-driven valves such as magnetic latch solenoid valves having positive open and close actions. In the case of control valve 68, a conventional non-latching electromechanical solenoid valve has worked well.

On reaching a preselected depth, as may be determined by the length of suspension cable paid out or by a depth sensing device mounted to apparatus 10, not shown, transducer apparatus 10 is tuned for resonance. Control valve 76, through which gas pressure at slighly above ambient pressure passes, is closed. Loudspeaker 44 is then driven by a preselected signal transmitted over signal link 70 through link 70D. Diaphragm 56 is next expanded to resonant pressure by feeding gas, regulated at above ambient pressure, from first pressure regulator 30. Accurate control of this feeding is done through first control valve 68 that can be, for example, a conventional electromechanical control valve such as a type that opens while being energized. Diaphragm resonance can be determined, for example, by placing a hydrophone nearby apparatus 10. Resonance would be attained when hydrophone output is maximum for minimum power delivered to loudspeaker 44.

It must be noted that net 62, surrounding diaphragm 56, must not have meshes that are so constraining as to prevent appreciable vibration of diaphragm 56. For example, a ten inch diameter generally spherical diaphragm expanded within a net of about 13 inches in diameter was found to vibrate well when constrained by generally diamond shaped meshes of one quarter by three eighths of an inch. Of course, these dimensions are not intended to limit the invention, but are given by way of example only.

Additionally, for example, it was found that a net made of a sythetic material, such as "Nylon", performed superiorly to nets made of a natural textile. The nets made of natural materials had generally lesser strength than those of the sythetics, and were found to stretch less predictably when wet.

By placing net 62 about diaphragm 56, diaphragm 56 is restrained from migrating due to buoyancy, and is impeded from overexpanding. Net 62 additionally increases the strength and stiffness of diaphragm 56, thereby increasing the resonance frequency, impedence and quality factor of the diaphragm while decreasing the bandwidth of the transmitted acoustic signals. Further, by constraining the diaphragm as illustrated, higher transducer source levels are possible as compared to a diaphragm not constrained in this manner.

It should be noted that the gas-flow-passageway from enclosure 48 to diaphragm 56, vent 78, is dimensioned to prevent acoustic coupling between the diaphragm (front) side of loudspeaker 44 and the enclosure (back) side of the loudspeaker. Yet, vent 78 is dimensioned to be large enough to permit gas to be freely exchanged for pressurization purposes. This vent may be of a cross sectional area substantially equal to that of the individual incoming gas ducts of control valves 68 and 76, to permit equal gas exchange between the diaphragm and transducer enclosure while providing minimal acoustic coupling effects. For example, typical embodiments of the invention included a vent hole of about three-sixteenths of an inch in diameter for a eight inch diameter transducer enclosure housing a six and one-half inch diameter loudspeaker.

Upon ascent of transducer apparatus 10, first control valve 68 and second control valve 76 are closed. Third control valve 80 is then opened to permit venting of the interior of enclosure 48 and diaphragm 56. As is shown in FIG. 1, vent line 84 is positioned to discharge gas below the loudspeaker level. This orientation of vent line 84 permits some pressure to be maintained within enclosure 48 and diaphragm 56 so that diaphragm 56 will not collapse and penetrate loudspeaker 44.

Though apparatus 10 is shown as incorporating a signal link tethered to a remote signal source, it would be possible, within sound engineering principles, to incorporate an independent signal generator and microprocessor with apparatus 10. This signal generator and microprocessor, and any accompanying energy sources such as batteries, could be disposed within the transducer enclosure of the invention. By fashioning the invention in this manner, apparatus 10 could be used as an expendable transducer system.

Further, though apparatus 10 has been shown as incorporating a generally spherical diaphragm 54, diaphragms of other shapes could be incorporated with the invention and fashioned with a constraining net in a similar manner as disclosed. Additionally, constraining nets of other than a spherical configuration could be used with the invention to peripherally constrain an enclosed diaphram to other than a spherical shape.

Obviously, those skilled in the art will realize that these and other modifications and variations of the invention are possible in light of the above teachings. Therefore, it is to be understood that within the scope of the following claims the invention may be practiced otherwise than as specifically described.

What is claimed is:

1. An apparatus for propagating acoustic energy through an aqueous medium comprising:

acoustic transducer means for converting electrical energy into acoustic energy;

enclosure means covering said transducer means for protecting said transducer means from the effects of said aqueous medium, said enclosure means having an open end through which said acoustic energy may pass;

a resilient diaphragm sealingly covering said open end of said enclosure means and having the property to transmit said acoustic energy from said transducer means to said aqueous medium;

constraining means covering said diaphragm and attached to said enclosure means for peripherally constraining said diaphragm;

a source of pressurized gas fluidly connected to said diaphragm and said enclosure means;

pressure regulating means for regulating the pressure of said gas to said diaphragm and said enclosure means;

control means for controlling delivery of said gas to said diaphragm and said enclosure means; and control means for controlling delivery of said gas from said diaphragm and said enclosure means to the ambient.

2. The apparatus of claim 1 in which said pressure regulating means includes:

a first pressure regulating means for delivering said gas to said diaphragm and said enclosure means at a first preselected pressure; and a second pressure regulating means for delivering said gas to said diaphragm and said enclosure means at a second preselected pressure.

3. An apparatus for propagating acoustic energy through water comprising:

acoustic transducer means for converting electrical signals into acoustic signals;

enclosure means covering said transducer means for protecting said transducer means from the effects of said water, said enclosure means having an open end through which said acoustic signals may pass;

a resilient, expandable diaphragm sealingly covering said open end of said enclosure means and having the property to transmit acoustic signals from said acoustic transducer means to said water;

constraining means covering said diaphragm and attached to said enclosure means for dimensionally constraining said diaphragm;

a source of pressurized gas;

first pressure regulating means for delivering said gas to said diaphragm and said enclosure means at a first preselected pressure;

first control means for controlling delivery of said gas at said first preselected pressure;

second pressure regulating means for delivering said gas to said diaphragm and said enclosure means at a second preselected pressure;

second control means for controlling delivery of said gas at said second preselected pressure; and third control means for controlling delivery of said gas from said diaphragm and said enclosure means to the ambient.

4. The apparatus of claim 3 in which said constraining means includes a net.

5. The apparatus of claim 4 in which said first preselected pressure is above the pressure of the ambient, and in which said second preselected pressure is slightly above ambient pressure.

6. The apparatus of claim 5 in which said acoustic transducer means includes a loudspeaker.

7. A sound transducer apparatus for operation under water comprising:

a signal link;

a loudspeaker having a front side and a back side, said loudspeaker being connected to said signal link;

a substantially rigid and water-tight enclosure covering said back side of said loudspeaker and being attached thereto to resist the pressure of said water on said loudspeaker an to substantially seal said loudspeaker from said water;

an elastic, inflatable and substantially water-impermeable bladder covering said front side of said loudspeaker and being placed over an open end of said enclosure and being sealed thereto, said bladder having the property to transmit acoustic signals from said loudspeaker to said water;

a net attached to said enclosure for peripherally constraining said bladder, said net defining a plurality of meshes through which said acoustic signals pass;

a supply of pressurized gas;

a conduit for passing said gas to said bladder and said enclosure;

a first pressure regulator in fluid communication with said gas to deliver said gas at above ambient pressure;

a first control in fluid communication with said gas to control delivery of said gas at said above ambient pressure, said first control connected to said signal link;

a second pressure regulator in fluid communication with said gas to deliver said gas at slightly above ambient pressure;

a second control in fluid communication with said gas to control delivery of said gas at said slightly above ambient pressure, said second control connected to said signal link; and a third control to control delivery of said gas from said bladder and said enclosure to the ambient, said third control connected to said signal link.

8. The sound assembly of claim 7 in which said first and second pressure regulators are dome-loaded pressure regulators.

9. The sound transducer assembly of claim 8 in which said first, second and third controls include electromechanical valves.

* * * * *